US010967211B2

(12) United States Patent
Cortner et al.

(10) Patent No.: US 10,967,211 B2
(45) Date of Patent: Apr. 6, 2021

(54) DRY POWDER FIRE-FIGHTING COMPOSITION

(71) Applicant: Halliburton Energy Services, Inc., Houston, TX (US)

(72) Inventors: Thomas S Cortner, Houston, TX (US); Ronald Coufal, Houston, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 15/120,652

(22) PCT Filed: Jul. 1, 2014

(86) PCT No.: PCT/US2014/045046
§ 371 (c)(1),
(2) Date: Aug. 22, 2016

(87) PCT Pub. No.: WO2016/003440
PCT Pub. Date: Jan. 7, 2016

(65) Prior Publication Data
US 2017/0165514 A1 Jun. 15, 2017

(51) Int. Cl.
*A62D 1/00* (2006.01)
*A62C 13/00* (2006.01)
*A62C 13/64* (2006.01)

(52) U.S. Cl.
CPC ..... *A62D 1/0014* (2013.01); *A62C 13/006* (2013.01); *A62D 1/0064* (2013.01); *A62C 13/64* (2013.01)

(58) Field of Classification Search
CPC .. A62D 1/0014; A62D 1/0064; A62C 13/006; A62C 13/64
USPC ..... 169/46
See application file for complete search history.

(56) References Cited

U.S. PATENT DOCUMENTS 2,212,735 A * 8/1940 Guthrie ..... A62D 1/0014 169/47
2,969,116 A 1/1961 Guise
3,090,749 A 5/1963 Warnock
3,976,580 A 8/1976 Kaminstein et al.
4,076,540 A 2/1978 Stossel
(Continued)

FOREIGN PATENT DOCUMENTS

CN 102327730 A1 1/2012
CN 102500086 A 6/2012
(Continued)

OTHER PUBLICATIONS

"All About Fire, from A Reporters Guide to Fire and the NFPA", [online]. [archived Oct. 23, 2014]. © 2014 National Fire Protection Association. Retrieved from the Internet: <URL:http://web.archive.org/web/20141023120010/http://www.nfpa.org/press-room/reports-guide-to-fire-and-nfpa/all-about-fire>, (2014), 2 pgs.
(Continued)

*Primary Examiner* — Chee-Chong Lee
(74) *Attorney, Agent, or Firm* — Chamberlain Hrdlicka

(57) ABSTRACT

Various embodiments disclosed relate to dry powder fire-fighting compositions. In various embodiments, the present invention provides a method of fighting a fire. The method can include contacting at least one of a fire and a source thereof with a composition including bentonite and aluminum hydroxide.

15 Claims, 1 Drawing Sheet

(56) References Cited

U.S. PATENT DOCUMENTS

| | | | | |
|---|---|---|---|---|
| 4,251,430 | A | 2/1981 | Kennedy-skipton et al. | |
| 4,419,401 | A * | 12/1983 | Pearson | C08G 16/0206 427/389.9 |
| 5,132,030 | A * | 7/1992 | Marx | A62D 1/0014 169/44 |
| 5,300,621 | A * | 4/1994 | Inata | C08G 63/181 528/176 |
| 5,518,638 | A | 5/1996 | Buil et al. | |
| 5,849,210 | A | 12/1998 | Pascente et al. | |
| 7,592,380 | B2 | 9/2009 | Fournier et al. | |
| 7,661,483 | B2 | 2/2010 | Mulukutla et al. | |
| 8,257,607 | B1 | 9/2012 | Johnson et al. | |
| 2005/0139363 | A1 * | 6/2005 | Thomas | A62C 3/025 169/30 |
| 2005/0181970 | A1 | 8/2005 | Huang | |
| 2006/0090271 | A1 * | 5/2006 | Price | D06M 13/00 8/490 |
| 2006/0100323 | A1 * | 5/2006 | Schmidt | C08K 5/19 524/106 |
| 2011/0288210 | A1 | 11/2011 | Pinnavaia et al. | |
| 2012/0228548 | A1 | 9/2012 | Kawai et al. | |
| 2013/0264509 | A1 | 10/2013 | Shalev et al. | |

FOREIGN PATENT DOCUMENTS

| | | | |
|---|---|---|---|
| CN | 103865162 | A1 | 6/2014 |
| EP | 309881 | B1 | 7/1994 |
| JP | 2011012239 | A | 1/2011 |
| RO | 108650 | B1 | 7/1994 |
| WO | 2006018278 | A1 | 2/2006 |

OTHER PUBLICATIONS

"Alumina Trihydrate", [online}, [online], [retrieved on Apr. 23, 2014]. Retrieved from the Internet: <URL: http://web.archive.org/web/20140423023647/http://www.rjmarshall.com/bayer-alumina-trihydrate-ath>, (2014), 2 pgs.

"Aqueous Film Forming Foams and PFCs", [online]. Minnesota Department of Health. Retrieved from the Internet: <URL: http://www.health.state.mn.us/divs/eh/hazardous/topics/pfcs/afff.html>>, (Dec. 8, 2015), 1-2.

"How Our Fire Retardant Additives Work", [online]. [retrieved on Apr. 13, 2014]. Retrieved from the Internet: <URL:, http://web.archive.org/web/20140413022941/http://www.hubermaterials.com/products/alumina-trihydrate-ath-magnesium-hydroxide-mdh/flame-retardants-smoke-suppressants/how-flame-retardants-smoke-suppressants-work.aspx>, (2014), 2 pgs.

"International Application Serial No. PCT/US2014/045046, International Search Report dated Mar. 26, 2015", 3 pgs.

"International Application Serial No. PCT/US2014/045046, Written Opinion dated Mar. 26, 2015", 10 pgs.

Notice of Allowance dated Dec. 11, 2018 for Canadian patent application No. 2,947,004, filed on Jul. 1, 2014.

First Examination Report dated Feb. 25, 2020 for GB application No. 1618882.3, filed Jul. 1, 2014.

* cited by examiner

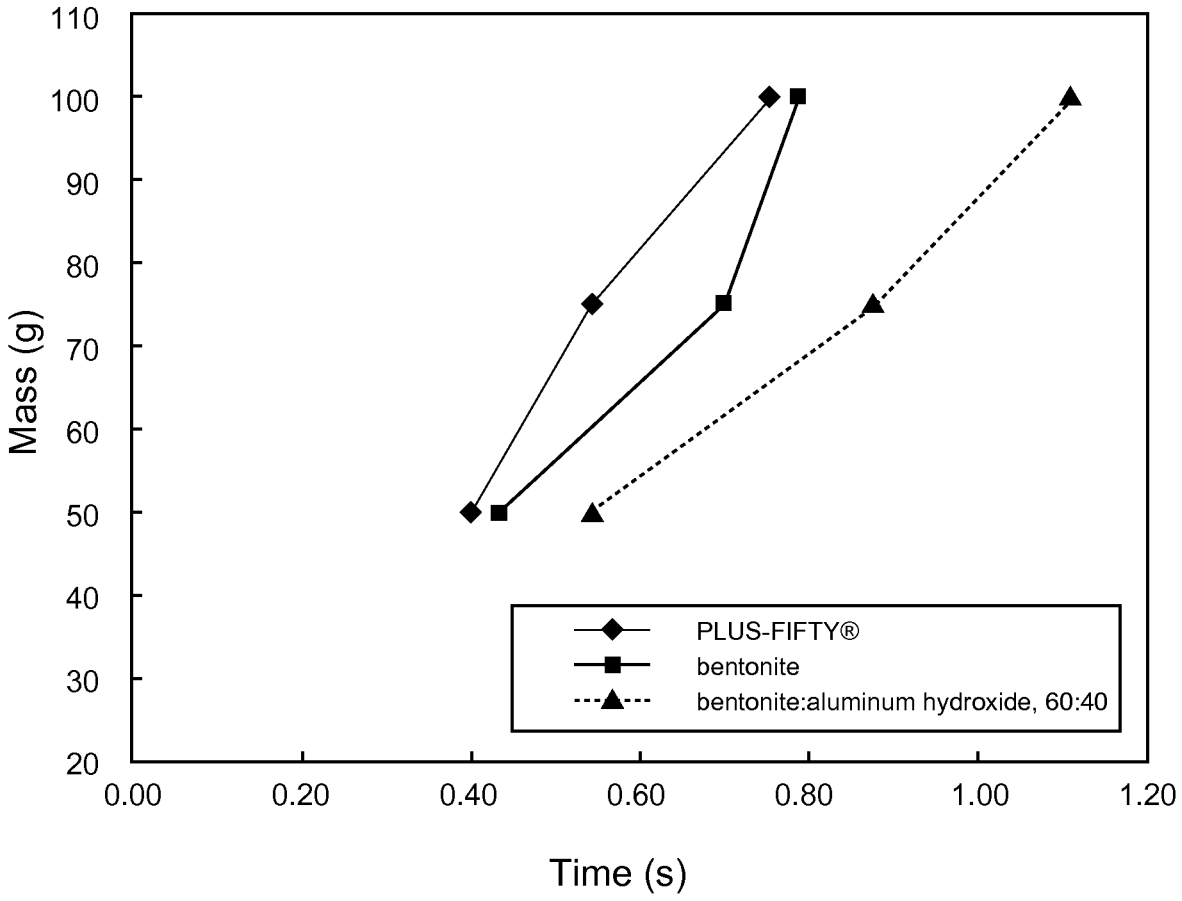
110
100
90
80
70
60
50
40
30
20
Mass (g)
0.00
0.20
0.40
0.60
0.80
1.00
1.20
Time (s)
PLUS-FIFTY®
bentonite
bentonite:aluminum hydroxide, 60:40

DRY POWDER FIRE-FIGHTING COMPOSITION

RELATED APPLICATIONS

This application is a U.S. National Stage Filing under 35 U.S.C. 371 of International Patent Application Serial No. PCT/US2014/045046, filed Jul. 1, 2014, and published on Jan. 7, 2016 as WO 2016/003440 A1, the benefit of priority of which is claimed hereby and which is incorporated by reference herein in its entirety.

BACKGROUND OF THE INVENTION

Fires and the associated smoke and toxic materials produced can be extremely destructive to structures and equipment as well as causing hazards to human and animal life. Fire is a complex, dynamic, physicochemical phenomenon and is a result of a rapid chemical reaction generating smoke, heat, flame, and light. Each fire exhibits individual characteristics that depend on the types of burning materials and environmental conditions.

Four components are necessary to sustain any fire: fuel, heat, oxygen, and an uninhibited chemical chain reaction. It thus follows that a fire may extinguished by at least one of removing the fuel, cooling the burning material, excluding oxygen, and inhibiting the chemical chain reaction. Available compositions for fire-fighting often suffer from high cost, little to no binding to a targeted area, and little to no removal of heat from the fire leading to inadequate reduction of the fire and inadequate suppression of fire spreading.

BRIEF DESCRIPTION OF THE FIGURES

The drawings illustrate generally, by way of example, but not by way of limitation, various embodiments discussed in the present document.

FIG. 1 illustrates the flow characteristics of various fire-extinguishing blends, in accordance with various embodiments.

DETAILED DESCRIPTION OF THE INVENTION

Reference will now be made in detail to certain embodiments of the disclosed subject matter. While the disclosed subject matter will be described in conjunction with the enumerated claims, it will be understood that the exemplified subject matter is not intended to limit the claims to the disclosed subject matter.

Values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "about 0.1% to about 5%" or "about 0.1% to 5%" should be interpreted to include not just about 0.1% to about 5%, but also the individual values (e.g., 1%, 2%, 3%, and 4%) and the sub-ranges (e.g., 0.1% to 0.5%, 1.1% to 2.2%, 3.3% to 4.4%) within the indicated range. The statement "about X to Y" has the same meaning as "about X to about Y," unless indicated otherwise. Likewise, the statement "about X, Y, or about Z" has the same meaning as "about X, about Y, or about Z," unless indicated otherwise.

In this document, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed herein, and not otherwise defined, is for the purpose of description only and not of limitation. Any use of section headings is intended to aid reading of the document and is not to be interpreted as limiting; information that is relevant to a section heading may occur within or outside of that particular section.

In the methods of manufacturing described herein, the steps can be carried out in any order without departing from the principles of the invention, except when a temporal or operational sequence is explicitly recited. Furthermore, specified steps can be carried out concurrently unless explicit claim language recites that they be carried out separately. For example, a claimed step of doing X and a claimed step of doing Y can be conducted simultaneously within a single operation, and the resulting process will fall within the literal scope of the claimed process.

The term "about" as used herein can allow for a degree of variability in a value or range, for example, within 10%, within 5%, or within 1% of a stated value or of a stated limit of a range.

The term "substantially" as used herein refers to a majority of, or mostly, as in at least about 50%, 60%, 70%, 80%, 90%, 95%, 96%, 97%, 98%, 99%, 99.5%, 99.9%, 99.99%, or at least about 99.999% or more.

The term "alkyl" as used herein refers to straight chain and branched alkyl groups and cycloalkyl groups having from 1 to 40 carbon atoms, 1 to about 20 carbon atoms, 1 to 12 carbons or, in some embodiments, from 1 to 8 carbon atoms. Examples of straight chain alkyl groups include those with from 1 to 8 carbon atoms such as methyl, ethyl, n-propyl, n-butyl, n-pentyl, n-hexyl, n-heptyl, and n-octyl groups. Examples of branched alkyl groups include, but are not limited to, isopropyl, iso-butyl, sec-butyl, t-butyl, neopentyl, isopentyl, and 2,2-dimethylpropyl groups. As used herein, the term "alkyl" encompasses n-alkyl, isoalkyl, and anteisoalkyl groups as well as other branched chain forms of alkyl. Representative substituted alkyl groups can be substituted one or more times with any of the groups listed herein, for example, amino, hydroxy, cyano, carboxy, nitro, thio, alkoxy, and halogen groups.

As used herein, the term "hydrocarbyl" refers to a functional group derived from a straight chain, branched, or cyclic hydrocarbon, and can be alkyl, alkenyl, alkynyl, aryl, cycloalkyl, acyl, or any combination thereof.

The term "solvent" as used herein refers to a liquid that can dissolve a solid, liquid, or gas. Nonlimiting examples of solvents are silicones, organic compounds, water, alcohols, ionic liquids, and supercritical fluids.

As used herein, the term "polymer" refers to a molecule having at least one repeating unit and can include copolymers.

The term "copolymer" as used herein refers to a polymer that includes at least two different repeating units. A copolymer can include any suitable number of repeating units.

In various embodiments, the present invention provides a method of fighting a fire. The method includes contacting at least one of a fire and a source thereof with a fire-fighting composition including bentonite and aluminum hydroxide.

In various embodiments, the present invention provides a method of fighting a fire. The method includes contacting at least one of a fire and a source thereof with a fire-fighting composition. The fire includes at least one of a class A fire and a class B fire. The contacting is sufficient to extinguish at least part of the fire or decrease the intensity of at least part of the fire. The fire-fighting composition includes about 60 wt % to about 90 wt % bentonite. The bentonite has a median particle diameter ($D_{50}$) of about 40 μm to about 150 μm. The fire-fighting composition also includes about 30 wt % to about 70 wt % aluminum hydroxide. The aluminum hydroxide has a median particle diameter ($D_{50}$) of about 40 μm to about 150 μm. The median particle diameter ($D_{50}$) of the aluminum hydroxide and the median particle diameter ($D_{50}$) of the bentonite are within about 50 μm of one another. The ratio of the mass of the bentonite to the mass of the aluminum hydroxide is about 0.5:1 to about 2:1.

In various embodiments, the present invention provides an apparatus for fire-fighting. The apparatus includes a portable fire extinguisher. The portable fire extinguisher includes therein one or more pressurized gases. The portable fire extinguisher also includes therein a composition including bentonite and aluminum hydroxide. The one or more pressurized gases are configured in the portable fire extinguisher sufficiently to expel the composition upon triggering by a user of the portable fire extinguisher.

In various embodiments, the present invention provides a composition for fire-fighting. The composition includes bentonite. The composition also includes aluminum hydroxide.

In various embodiments, the present invention provides a composition for fire-fighting. The composition is a dry powder composition. The composition includes about 60 wt % to about 90 wt % bentonite having a median particle diameter ($D_{50}$) of about 40 μm to about 150 μm. The composition includes about 30 wt % to about 70 wt % aluminum hydroxide having a median particle diameter ($D_{50}$) of about 40 μm to about 150 μm. The aluminum hydroxide and the bentonite have median particle diameters ($D_{50}$) that are within about 50 μm of one another. The ratio of the mass of the bentonite to the mass of the aluminum hydroxide is about 0.5:1 to about 2:1.

In various embodiments, the present invention provides a method of preparing a fire-fighting composition. The method includes forming a composition including bentonite and aluminum hydroxide.

Various embodiments of the present invention can have certain advantages over other compositions, systems, and apparatus for fighting fires, at least some of which are unexpected. For example, in some embodiments, the fire-fighting composition can smother a fire by preventing or reducing contact between the fuel and the air. In various embodiments, the fire can cause the aluminum hydroxide to undergo a dehydration reaction, removing heat from the fire, which can help to reduce the fire and can inhibit the fire from spreading. In various embodiments, as the aluminum hydroxide loses water, the water can be at least partially absorbed into the bentonite, forming an aqueous gel. In various embodiments, the aqueous gel formed can prevent water runoff, helping to keep water in a targeted area. In various embodiments, the aqueous gel can bind the fire-fighting composition to the targeted area, concentrating the cooling effect on the targeted area. In various embodiments, the aqueous gel can help to smother the fire by further reducing fuel-air contact. In various embodiments, the fire can cause the bentonite to lose water or to lose other compounds incorporated therein, allowing the bentonite to absorb heat from the fire, decreasing the size of the fire and decreasing the rate at which the fire spreads.

Many fire extinguisher formulations suffer from the disadvantage of being environmentally unfriendly. For example, halogen-based formulations extinguish fires by interrupting the chemical chain reaction, but the smoke generated from these compounds is toxic. Aqueous film forming foams (AFFFs) often incorporate toxic fluorosurfactants such as perfluorooctane sulfonate, which can contaminate groundwater and living organisms. In various embodiments, the composition including the bentonite and aluminum hydroxide is relatively harmless and it creates little to no environmentally-unfriendly residue subsequent to the use of the composition on a fire.

Compared to other fire extinguisher blends, various embodiments of the composition can be considerably more economical. In various embodiments, the total number of components in the composition can be small, and both aluminum hydroxide and bentonite are inexpensive. Various embodiments have a larger median particle size ($D_{50}$) and a broader particle size distribution than other fire-fighting compositions, allowing for less expensive production.

Method of Fire-Fighting.

Various embodiments of the present invention provide a method of fire-fighting. The method includes contacting at least one of a fire and the source of the fire (e.g., the fuel source that burns to produce the flames of the fire) with a fire-fighting composition including bentonite and aluminum hydroxide. The contacting is sufficient to extinguish at least part of the fire or decrease the intensity of at least part of the fire. The contacting is of sufficient magnitude and duration such that at least some extinguishing or decrease in intensity of the fire occurs.

The fire can be any suitable fire. In some examples, the fire can include at least one of a U.S. Class A fire (e.g., including ordinary combustibles such as wood, paper, fabric, plastic, or trash), a U.S. Class B fire (e.g., including flammable or combustible liquid or gas), a U.S. Class C fire (e.g., an electrical fire including energized or potentially energized electrical equipment), a U.S. Class D fire (e.g., a metal fire, including materials such as magnesium, potassium, titanium, or zirconium), and a U.S. Class K fire (e.g., cooking oils). In some embodiments, the fire can include at least one of a U.S. Class A fire, a U.S. Class B fire, and a U.S. Class C fire. In some embodiments, the fire can include at least one of a U.S. Class A fire and a U.S. Class B fire.

Embodiments of the fire-fighting composition are not limited to any particular mechanism of action; any suitable mechanism of action to inhibit or extinguish fires can occur during the method. In various embodiments, the fire-fighting composition including bentonite and aluminum hydroxide can eliminate oxygen and heat from a burning fire. The oxygen can be hampered from access to the burning material by the physical means of the powder suffocating the fire when it is spread over the source by blocking the interface between fuel and the surrounding air. The aluminum hydroxide in the composition can remove heat via an endothermic dehydration reaction (e.g., $Al_3O_2.3H_2O$ can convert to $Al_3O_2$ plus 3 water molecules), which can occur around 220° C., causing flame retardation and smoke suppression. As fuel for the fire is cooled below its combustion point, the fire can be inhibited from spreading. The bentonite can also absorb heat as it dehydrates, with thermal energy being absorbed as interlayer water is removed between about 100° C. and about 200° C., and when lattice water is removed (e.g., at about 500° C.). Similar cooling can occur concomitant with loss of other groups such as carboxylate, nitrate, sulfate, and other functional groups present in the bentonite.

In some embodiments, as water is released from the aluminum hydroxide it can at least partially hydrate the bentonite to create an aqueous gel. A viscous gel of this nature can offer several advantages over water in extinguishing a fire. For example, as the water-swellable bentonite absorbs moisture it can increase in viscosity, which can prevent water runoff toward untargeted areas. This can localize the cooling effect and minimize the required volume of extinguishing media. The gel can additionally enhance the smothering of the blend by further reducing fuel-air contact.

The composition can be any suitable fire-fighting composition including bentonite and aluminum hydroxide. In various embodiments, the composition is a powder. The composition can be a dry powder; for example, the composition can be a flowable powder not suspended in any fluid media. In some embodiments, prior to contacting with the fire or source thereof, the composition can have about no water (e.g., in the form of $H_2O$ that is uncomplexed and unincorporated into any crystalline lattice of a salt or any other compound) or about 0.000, 1 wt % water or less, or about 0.001 wt % water, 0.005, 0.01, 0.05, 0.1, 0.5, 1, 1.5, 2, 2.5, 3, 3.5, 4, 4.5, 5, 6, 7, 8, 9, 10, 12, 14, 16, 18, 20, 22, 24, 26, 28, or about 30 wt % water or more. In some embodiments, prior to contacting with the fire or source thereof, the composition can have about no liquid (e.g., water, organic solvents, oils, and the like, uncomplexed and unincorporated into any crystalline lattice of a salt or any other compound) or about 0.000, 1 wt % or less, or about 0.001 wt %, 0.005, 0.01, 0.05, 0.1, 0.5, 1, 1.5, 2, 2.5, 3, 3.5, 4, 4.5, 5, 6, 7, 8, 9, 10, 12, 14, 16, 18, 20, 22, 24, 26, 28, or about 30 wt % or more liquid.

The method can include dispersing the composition for a fire extinguisher, such as a portable fire extinguisher, prior to the contacting of the fire-fighting composition and the fire or source thereof. The fire extinguisher can include the fire-fighting composition and one or more pressurized gases for dispersing the composition.

Bentonite and Aluminum Hydroxide.

The fire-fighting composition includes bentonite. The bentonite can be any one or more suitable bentonites, and can make up any suitable proportion of the composition, such that the composition can be used as described herein, such as about 10 wt % to about 90 wt %, about 30 wt % to about 70 wt %, about 10 wt % or less, or about 15 wt %, 20, 25, 30, 35, 40, 45, 50, 55, 60, 65, 70, 75, 80, 85, or about 90 wt % or more.

The bentonite can include at least one of sodium bentonite and calcium bentonite. In some embodiments the bentonite is substantially sodium bentonite. The bentonite can be untreated sodium bentonite clay. The bentonite can be untreated Wyoming sodium bentonite clay. The bentonite can include montmorillonite, for example, having the formula $(Na,Ca)_{0.33}(Al,Mg,Fe)_2(Si_4O_{10})(OH)_2.nH_2O$. The montmorillonite can include sodium montmorillonite. The montmorillonite can form any suitable proportion of the bentonite, such as about 40 wt % to about 100 wt %, or about 80 wt % to about 95 wt %, or about 40 wt % or less, or about 45 wt %, 50, 55, 60, 65, 70, 75, 80, 82, 84, 86, 88, 90, 92, 94, 96, 98, 99, 99.9, 99.99, or about 99.999 wt % or more.

The bentonite can include water (e.g., as uncomplexed/unincorporated free water or as water that is complexed with or incorporated into crystalline lattices of the bentonite or components thereof). In some embodiments, the bentonite is substantially free of water. In some embodiments, the bentonite has less than 2 wt %, 4, 6, 8, 10, 12, 14, 16, 18, or less than 20 wt % of water, or has about 0 wt % to about 20 wt % water, or about 0.001 wt % or less, or about 0.01 wt %, 0.1, 1, 2, 4, 6, 8, 10, 12, 14, 16, 18, or about 20 wt % water or more.

The bentonite can include at least one of feldspar (e.g., potassium feldspar or plagioclase), quartz, gypsum, dolomite, illite, mica, calcite, opal, dolomite, siderite, and clinoptilolite. For example, about 5 wt % to about 20 wt % of the bentonite can be at least one of feldspar, quartz, gypsum, dolomite, illite, mica, calcite, opal, dolomite, siderite, and clinoptiloliteor about 7 wt % to about 13 wt %, or about 5 wt % or less, or about 6, 7, 8, 9, 10, 11, 12, 13, 14, 15, 16, 17, 18, 19, or about 20 wt % or more of the bentonite is at least one of feldspar, quartz, gypsum, dolomite, illite, mica, calcite, opal, dolomite, siderite, and clinoptilolite.

The bentonite can have any suitable bulk compacted density. For example, the bentonite can have a bulk compacted density of about 30 $lb/ft^3$ to about 95 $lb/ft^3$, about 40 $lb/ft^3$ to about 95 $lb/ft^3$, about 65 $lb/ft^3$ to about 80 $lb/ft^3$, about 30 $lb/ft^3$ or less, or about 32, 34, 36, 38, 40, 42, 44, 46, 48, 50, 52, 54, 56, 58, 60, 62, 64, 65, 66, 67, 68, 69, 70, 71, 72, 73, 74, 75, 76, 77, 78, 79, 80, 81, 82, 83, 84, 85, 86, 88, 90, 92, 94, or about 95 $lb/ft^3$ or more. In some examples, the bentonite can have a bulk uncompacted density of about 40 $lb/ft^3$ to about 95 $lb/ft^3$, about 55 $lb/ft^3$ to about 80 $lb/ft^3$, about 40 $lb/ft^3$ or less, or about 40, 45, 50, 55, 60, 62, 64, 66, 68, 70, 72, 74, 76, 78, 80, 82, 84, 86, 88, 90, 92, 94, or about 95 $lb/ft^3$ or more.

The bentonite can be granular and can have any suitable median particle diameter, which can be the largest dimension of a particle. The $D_{50}$ median particle diameter can be the value of the diameter at which 50 volume % of the particles have a larger particle diameter, and 50 volume % of the particles have a smaller particle diameter. For example, the bentonite can have a median particle diameter ($D_{50}$) of about 10 μm to about 600 μm, about 40 μm to about 150 μm, about 60 μm to about 90 μm, or about 10 μm or less, or about 15 μm, 20, 25, 30, 35, 40, 45, 50, 55, 60, 62, 64, 66, 68, 70, 71, 72, 73, 74, 75, 76, 77, 78, 79, 80, 82, 84, 86, 88, 90, 95, 100, 105, 110, 115, 120, 125, 130, 135, 140, 150, 160, 170, 180, 190, 200, 225, 250, 275, 300, 350, 400, 450, 500, 550, or about 600 μm or more. In some embodiments, about 70 wt % to about 100 wt % of the bentonite particles can have a particle diameter between about 10 μm to about 600 μm, about 40 μm to about 150 μm, about 60 μm to about 90 μm, or about 90 wt % to about 98 wt %, or about 70 wt % or less, or about 75, 80, 82, 84, 86, 88, 90, 91, 92, 93, 94, 95, 96, 97, 98, 99, 99.9, 99.99, or about 99.999 wt % or more of the bentonite particles. In some embodiments, about 0.01 wt %, 0.1, 1, 2, 3, 4, 5, 6, 7, 8, 9, or about 10 wt % or more of the bentonite particles can have a particle diameter larger than about 10 μm, about 40 μm, or larger than about 60 μm. In some embodiments, about 0.000, 1 wt %, 0.001, 0.01, 0.1, 1, 1.5, 2, 2.5, 3, 3.5, 4, 5, 6, 7, 8, 9, or about 10 wt % or more of the bentonite particles can have a particle diameter that is smaller than 600 μm, about 150 μm, or smaller than about 90 μm.

The fire-fighting composition includes aluminum hydroxide. The aluminum hydroxide can be any one or more suitable aluminum hydroxides, and can make up any suitable proportion of the composition, such that the composition can be used as described herein, such as about 10 wt % to about 90 wt %, about 30 wt % to about 70 wt %, about 10 wt % or less, or about 15 wt %, 20, 25, 30, 35, 40, 45, 50, 55, 60, 65, 70, 75, 80, 85, or about 90 wt % or more. The aluminum hydroxide can be at least one of $Al(OH)_3$ and $Al_2O_3.3H_2O$. The aluminum hydroxide can be at least one of gibbsite, bayerite, doyelite, and nordstrandite.

The ratio of the mass of the bentonite to the mass of the aluminum hydroxide can be any suitable ratio, such as about 0.1:1 to about 10:1, about 0.5:1 to about 2:1, about 0.9:1 to about 1.1:1, or about 0.1:1 or less, or about 0.2:1, 0.3:1, 0.4:1, 0.5:1, 0.6:1, 0.7:1, 0.8:1, 0.9:1, 1:1, 1.1:1, 1.2:1, 1.3:1, 1.4:1, 1.5:1, 1.6:1, 1.7:1, 1.8:1, 1.9:1, 2:1, 3:1, 4:1, 5:1, 6:1, 7:1, 8:1, 9:1, or about 10:1 or more.

The aluminum hydroxide can be granular and can have any suitable median particle diameter, which can be the largest dimension of a particle. For example, the aluminum hydroxide can have a median particle diameter ($D_{50}$) of about 10 μm to about 600 μm, about 40 μm to about 150 μm, about 60 μm to about 90 μm, or about 10 μm or less, or about 15 μm, 20, 25, 30, 35, 40, 45, 50, 55, 60, 62, 64, 66, 68, 70, 71, 72, 73, 74, 75, 76, 77, 78, 79, 80, 82, 84, 86, 88, 90, 95, 100, 105, 110, 115, 120, 125, 130, 135, 140, 150, 160, 170, 180, 190, 200, 225, 250, 275, 300, 350, 400, 450, 500, 550, or about 600 μm or more. In some embodiments, about 70 wt % to about 100 wt % of the aluminum hydroxide particles can have a particle diameter between about 10 μm to about 600 μm, about 40 μm to about 150 μm, about 60 μm to about 90 μm, or about 90 wt % to about 98 wt %, or about 70 wt % or less, or about 75, 80, 82, 84, 86, 88, 90, 91, 92, 93, 94, 95, 96, 97, 98, 99, 99.9, 99.99, or about 99.999 wt % or more of the aluminum hydroxide particles. In some embodiments, about 0.01 wt %, 0.1, 1, 2, 3, 4, 5, 6, 7, 8, 9, or about 10 wt % or more of the aluminum hydroxide particles can have a particle diameter larger than about 10 μm, about 40 μm, or larger than about 60 μm. In some embodiments, about 0.000, 1 wt %, 0.001, 0.01, 0.1, 1, 1.5, 2, 2.5, 3, 3.5, 4, 5, 6, 7, 8, 9, or about 10 wt % or more of the aluminum hydroxide particles can have a particle diameter that is smaller than 600 μm, about 150 μm, or smaller than about 90 μm.

In various embodiments, the aluminum hydroxide and the bentonite can have a median particle diameter ($D_{50}$) that is within about 1 μm to about 500 μm of one another, or within about 20 μm to about 200 μm of one another, or about 30 μm to about 100 μm of each other, about 0 μm (e.g., the aluminum hydroxide and the bentonite can have a median particle diameter ($D_{50}$) that is about the same), or about 1 μm or less of one another, or about 2 μm, 3, 4, 5, 6, 8, 10, 15, 20, 25, 30, 35, 40, 45, 50, 60, 70, 80, 90, 100, 125, 150, 175, 200, 250, 300, 400, or about 500 μm of one another or more.

In various embodiments, all of the particles in the fire-fighting composition can have a median particle diameter ($D_{50}$) that is within about 1 μm to about 500 μm of one another, or within about 20 μm to about 200 μm of one another, or about 30 μm to about 100 μm of each other, about 0 μm, or about 1 μm or less of one another, or about 2 μm, 3, 4, 5, 6, 8, 10, 15, 20, 25, 30, 35, 40, 45, 50, 60, 70, 80, 90, 100, 125, 150, 175, 200, 250, 300, 400, or about 500 μm of one another or more.

The composition, including all the particles therein, can have any suitable median particle diameter, which can be the largest dimension of a particle. For example, the composition can have a median particle diameter ($D_{50}$) of about 10 μm to about 600 μm, about 40 μm to about 150 μm, about 60 μm to about 90 μm, or about 10 μm or less, or about 15 μm, 20, 25, 30, 35, 40, 45, 50, 55, 60, 62, 64, 66, 68, 70, 71, 72, 73, 74, 75, 76, 77, 78, 79, 80, 82, 84, 86, 88, 90, 95, 100, 105, 110, 115, 120, 125, 130, 135, 140, 150, 160, 170, 180, 190, 200, 225, 250, 275, 300, 350, 400, 450, 500, 550, or about 600 μm or more. In some embodiments, about 70 wt % to about 100 wt % of the composition particles can have a particle diameter between about 10 μm to about 600 μm, about 40 μm to about 150 μm, about 60 μm to about 90 μm, or about 90 wt % to about 98 wt %, or about 70 wt % or less, or about 75, 80, 82, 84, 86, 88, 90, 91, 92, 93, 94, 95, 96, 97, 98, 99, 99.9, 99.99, or about 99.999 wt % or more of the composition particles. In some embodiments, about 0.01 wt %, 0.1, 1, 2, 3, 4, 5, 6, 7, 8, 9, or about 10 wt % or more of the composition particles can have a particle diameter larger than about 10 μm, about 40 μm, or larger than about 60 μm. In some embodiments, about 0.000, 1 wt %, 0.001, 0.01, 0.1, 1, 1.5, 2, 2.5, 3, 3.5, 4, 5, 6, 7, 8, 9, or about 10 wt % or more of the composition particles can have a particle diameter that is smaller than 600 μm, about 150 μm, or smaller than about 90 μm.

Other Components.

The fire-fighting composition, or a mixture including the composition, can include any suitable additional component in any suitable proportion, such that the composition, or mixture including the same, can be used as described herein.

The composition can include one or more flow agents or anticaking agents. The flow agent or anticaking agent can be any suitable flow agent or anticaking agent, such as at least one of silica, hydrophobically modified silica (e.g., silica having at least some Si—OH groups modified to be less hydrophilic, such as converted to —Si—O—($C_1$-$C_5$)alkyl groups or to —Si—O—Si(($C_1$-$C_5$)alkyl)$_3$ groups), sodium silicate, calcium silicate, tricalcium phosphate, magnesium stearate, sodium bicarbonate, potassium bicarbonate, magnesium trisilicate, talc, sodium aluminosilicate, potassium aluminosilicate, calcium aluminosilicate, aluminum silicate, polydimethylsiloxane. The one or more flow agents or anticaking agents can be present in the composition in any suitable amount, such as about 0.001 wt % to about 5 wt % of the composition, about 0.001 wt % to about 2 wt %, about 0.5 wt % to about 1 wt %, about 0%, about 0.001 wt % or less, or about 0.005 wt %, 0.01, 0.05, 0.1, 0.5, 1, 1.5, 2, 2.5, 3, 3.5, 4, 4.5, or about 5 wt % of the composition or more.

In some embodiments, the composition, or a mixture including the same, can include any suitable amount of any material used in dry powder fire-fighting compositions. For example, the composition can further include at least one of an alkali metal bicarbonate (e.g., sodium bicarbonate or potassium bicarbonate), potassium chloride, an ammonium phosphate (e.g., monoammonium phosphate), a calcium phosphate (e.g., tricalcium phosphate), an addition product of urea with an alkali metal bicarbonate (e.g., with sodium bicarbonate or potassium bicarbonate), a metal salt of a fatty acid (e.g., a sodium, potassium, zinc, magnesium, or calcium salt of a ($C_5$-$C_{50}$)hydrocarbylcarboxylic acid, such as of a ($C_5$-$C_{50}$)alkanoic or alkenoic acid, such as zinc stearate or magnesium stearate), a silicone, a surfactant (e.g., a fluorocarbon surfactant), and mica. The composition, or a mixture including the same, can include at least one of water, a base, an oil, an organic solvent, a viscosifier, a crosslinker, a starch, cellulose or cellulose derivative, a sugar, a density control agent, a density modifier, an emulsifier, a dispersant, a polymeric stabilizer, polyacrylamide, a polymer or combination of polymers, an antioxidant, a plasticizer, a filler or inorganic particle, a pigment or dye, a rheology modifier, a surfactant, a corrosion inhibitor, a gas, a salt, a lubricant, a desiccant, a filler, a surface modifying agent, or a combination thereof. The composition can include any suitable amount of any one or more components listed in this paragraph, such as about 0.001 wt % to about 50 wt %, about 0.01 wt % to about 30 wt %, about 0.1 wt % to about 10 wt %, or about 0 wt %, about 0.001 wt % or less, or about 0.005, 0.01, 0.05, 0.1, 0.5, 1, 1.5, 2, 2.5, 3, 3.5, 4, 4.5, 5, 6, 7, 8, 9, 10, 12, 14, 16, 18, 20, 25, 30, 35, 40, 45, or about 50 wt % or more.

Fire-Fighting Composition.

Various embodiments provide a composition useful for fighting fires. The composition can be any suitable composition that can be used to perform an embodiment of the method for fighting fires described herein. For example, the composition can include bentonite and aluminum hydroxide.

In some embodiments, the composition can be a dry powder composition. The composition can include about 60 wt % to about 90 wt % bentonite. The bentonite can have a median particle diameter ($D_{50}$) of about 40 μm to about 150 μm. The composition can include about 30 wt % to about 70 wt % aluminum hydroxide. The aluminum hydroxide can have a median particle diameter ($D_{50}$) of about 40 μm to about 150 μm. The aluminum hydroxide and the bentonite can have median particle diameters ($D_{50}$) that are within about 50 μm of one another. The ratio of the mass of the bentonite to the mass of the aluminum hydroxide can be about 0.5:1 to about 2:1.

System or Apparatus.

In various embodiments, the present invention provides a system or apparatus for fire-fighting. The system or apparatus can be any suitable system or apparatus that can perform an embodiment of the method of using the fire-fighting composition described herein.

In one embodiment, the present invention provides a system including a fire-extinguishing apparatus that includes the fire-fighting composition including bentonite and aluminum hydroxide therein. In one embodiment, the present invention provides an apparatus for fire-fighting that includes a portable fire extinguisher, wherein the portable fire extinguisher includes one or more pressurized gases and the fire-fighting composition including bentonite and aluminum hydroxide.

The fire extinguishing apparatus or fire extinguisher can be any apparatus suitable for dispersing the fire-fighting composition such that it can contact a fire or a source thereof. The fire extinguishing apparatus can be a portable fire extinguisher, or can be permanently or semi-permanently installed in a specific location. A portable fire extinguisher can be a cylindrical pressure vessel with a valve that can be opened by a user of the extinguisher, and can be designed for hand-held use or cart-mounted use. The one or more pressurized gases can be in the same chamber as the fire-fighting composition, or can be in a separate cartridge that can be punctured prior to discharge.

Method for Preparing a Fire-Fighting Composition.

In various embodiments, the present invention provides a method for preparing a composition for fire-fighting. The method can be any suitable method that produces an embodiment of the fire-fighting composition described herein. For example, the method can include forming a composition including bentonite and aluminum hydroxide, such as by mixing the bentonite and the aluminum hydroxide.

EXAMPLES

Various embodiments of the present invention can be better understood by reference to the following Examples which are offered by way of illustration. The present invention is not limited to the Examples given herein.

The bentonite used was National® Standard that was sieved to remove the material passing through a 325 mesh screen. The bentonite had a $D_{10}$ of 32.67 μm (10 vol % of the particles had a diameter of 32.67 microns or less), a $D_{25}$ of 53.71 μm, a $D_{50}$ of 73.17 μm, a $D_{75}$ of 105.9 μm, and a $D_{90}$ of 139.3 μm. 0.00013 vol % of the particles had a diameter of 1 μm or less, 5.31 vol % of the particles had a diameter of 10 μm or less, 7.90 vol % of the particles had a diameter of 20 μm or less, 8.31 vol % of the particles had a diameter of 25 μm or less, and 14.4 vol % of the particles had a diameter of 44 μm or less.

The aluminum hydroxide used was "fine" particle size ATH from Riverland Industries, Inc. The aluminum hydroxide had a $D_{10}$ of 13.01 μm, a $D_{25}$ of 46.87 μm, a $D_{50}$ of 75.05 μm, a $D_{75}$ of 97.82 μm, and a $D_{90}$ of 116.8 μm. 0.25 vol % of the particles had a diameter of 1 μm or less, 8.17 vol % of the particles had a diameter of 10 μm or less, 13.3 vol % of the particles had a diameter of 20 μm or less, 15.3 vol % of the particles had a diameter of 25 μm or less, and 23.4 vol % of the particles had a diameter of 44 μm or less.

The 50:50 blend of BPM National® Standard and ATH from Riverland Industries, Inc. had a $D_{10}$ of 6.024 μm, a $D_{25}$ of 20.82 μm, a $D_{50}$ of 58.38 μm, a $D_{75}$ of 90.38 μm, and a $D_{90}$ of 116.5 μm. 0.26 vol % of the particles had a diameter of 1 μm or less, 16.1 vol % of the particles had a diameter of 10 μm or less, 24.5 vol % of the particles had a diameter of 20 μm or less, 27.0 vol % of the particles had a diameter of 25 μm or less, and 38.2 vol % of the particles had a diameter of 44 μm or less.

Example 1. Density and Particle Size

The density and $D_{50}$ of PLUS-FIFTY® (a sodium carbonate-based dry chemical fire-extinguishing composition), bentonite, a 60:40 (mass ratio) bentonite:aluminum hydroxide blend, and a 50:50 (mass ratio) bentonite:aluminum hydroxide blend. Density was measured as compacted density, adding 350-500 mL material to a graduated cylinder tared on a balance, agitating until a constant volume was achieved, and recording the resulting mass:volume ratio. The results are given in Table 1.

TABLE 1

Density and particle size.

| Sample | Component A | Component B | Ratio (A:B) | D50 A (μm) | D50 B (μm) | Density (lb/ft$^3$) |
|---|---|---|---|---|---|---|
| 1 | PLUS-FIFTY ® | — | — | 24.41 | — | 66.7 |
| 2 | bentonite | aluminum hydroxide | 60:40 | 44-74 | 75.05 | 68.9 |
| 3 | bentonite | aluminum hydroxide | 50:50 | 73.17 | 75.05 | 79.8 |
| 4 | bentonite | — | — | 44-74 | — | 67.9 |

Example 2. Flow Characteristics

Table 2 and FIG. 1 illustrates the flow characteristics of the PLUS-FIFTY®, bentonite, and of the 60:40 bentonite: aluminum hydroxide blend used in Example 1. The flow characteristics were determined by measuring the amount of time a particular mass of uncompacted sample flows from the bottom of a funnel by gravity. The times were determined from still frames of video. Each mass of each sample was tested three times.

TABLE 2

Flow characteristics.

| Sample | mass (g) | avg. flow time (s) | SD (s) |
|---|---|---|---|
| PLUS-FIFTY ® | 100 | 0.76 | 0.18 |
| PLUS-FIFTY ® | 75 | 0.54 | 0.04 |
| PLUS-FIFTY ® | 50 | 0.40 | 0.00 |
| bentonite | 100 | 0.79 | 0.05 |
| bentonite | 75 | 0.70 | 0.03 |

TABLE 2-continued

| Flow characteristics. | | | |
|---|---|---|---|
| Sample | mass (g) | avg. flow time (s) | SD (s) |
| bentonite | 50 | 0.43 | 0.06 |
| bentonite:aluminum hydroxide, 60:40 | 100 | 1.11 | 0.20 |
| bentonite:aluminum hydroxide, 60:40 | 75 | 0.88 | 0.15 |
| bentonite:aluminum hydroxide, 60:40 | 50 | 0.54 | 0.07 |

Example 3. Fire-Extinguishing Tests

The 50:50 bentonite:aluminum hydroxide blend was combined with 1 wt % Evonik Aerosil® R972, as a flow agent, to form a bentonite:aluminum hydroxide:R972 blend that was 49.5:49.5:1 mass ratio. A fire-extinguishing test was performed using the R972 blend and Foray® dry chemical extinguishing agent, a monoammonium phosphate-based dry chemical. The tests were performed on a diesel fire of consistent size for each test using an ANSUL® Model 1-A-20-G-1 extinguisher, using $CO_2$ cartridges, at approximately 200 psi pressure. The times were collected from still frames of video. The results are shown in Table 3.

TABLE 3

| Fire-extinguishing test. | | | |
|---|---|---|---|
| Sample | Time to extinguish Type B fire (s) | Total expulsion time (s) | Percent Material Expelled (%) |
| Foray | 1.53 | 29.63 | 99.4 |
| Bentonite:aluminum hydroxide:R972 49.5:49.5:1 | 2.73 | 26.77 | 95-97 |

Aluminum hydroxide and bentonite were tested individually under similar conditions and neither was found to be nearly as effective as a blend of the two materials.

The terms and expressions that have been employed are used as terms of description and not of limitation, and there is no intention in the use of such terms and expressions of excluding any equivalents of the features shown and described or portions thereof, but it is recognized that various modifications are possible within the scope of the embodiments of the present invention. Thus, it should be understood that although the present invention has been specifically disclosed by specific embodiments and optional features, modification and variation of the concepts herein disclosed may be resorted to by those of ordinary skill in the art, and that such modifications and variations are considered to be within the scope of embodiments of the present invention.

ADDITIONAL EMBODIMENTS

The following exemplary embodiments are provided, the numbering of which is not to be construed as designating levels of importance:

Embodiment 1 provides a method of fighting a fire, the method comprising:

contacting at least one of a fire and a source thereof with a composition comprising bentonite and aluminum hydroxide.

Embodiment 2 provides the method of Embodiment 1, wherein the contacting is sufficient to extinguish at least part of the fire or decrease the intensity of at least part of the fire.

Embodiment 3 provides the method of any one of Embodiments 1-2, wherein the composition is a powder.

Embodiment 4 provides the method of any one of Embodiments 1-3, wherein the composition is a dry powder.

Embodiment 5 provides the method of any one of Embodiments 1-4, wherein the fire comprises at least one of a class A and a class B fire.

Embodiment 6 provides the method of any one of Embodiments 1-5, further comprising dispersing the composition from a portable fire extinguisher prior to the contacting.

Embodiment 7 provides the method of Embodiment 6, wherein the portable fire extinguisher comprises the composition and one or more pressurized gases for dispersing the composition.

Embodiment 8 provides the method of any one of Embodiments 1-7, wherein about 10 wt % to about 90 wt % of the composition is the bentonite.

Embodiment 9 provides the method of any one of Embodiments 1-8, wherein about 30 wt % to about 70 wt % of the composition is the bentonite.

Embodiment 10 provides the method of any one of Embodiments 1-9, wherein about 30 wt % to about 90 wt % of the composition is the bentonite.

Embodiment 11 provides the method of any one of Embodiments 1-10, wherein about 60 wt % to about 80 wt % of the composition is the bentonite.

Embodiment 12 provides the method of any one of Embodiments 1-11, wherein the bentonite comprises at least one of sodium bentonite and calcium bentonite.

Embodiment 13 provides the method of any one of Embodiments 1-12, wherein the bentonite comprises untreated sodium bentonite clay.

Embodiment 14 provides the method of any one of Embodiments 1-13, wherein the bentonite comprises untreated Wyoming sodium bentonite clay.

Embodiment 15 provides the method of any one of Embodiments 1-14, wherein the bentonite comprises montmorillonite having the formula $(Na,Ca)_{0.33}(Al,Mg,Fe)_2(Si_4O_{10})(OH)_2.nH_2O$.

Embodiment 16 provides the method of any one of Embodiments 1-15, wherein the bentonite comprises sodium montmorillonite.

Embodiment 17 provides the method of any one of Embodiments 1-16, wherein about 40 wt % to about 100 wt % of the bentonite is montmorillonite.

Embodiment 18 provides the method of any one of Embodiments 1-17, wherein about 80 wt % to about 95 wt % of the bentonite is montmorillonite.

Embodiment 19 provides the method of any one of Embodiments 1-18, wherein about 0 wt % to about 20 wt % of the bentonite is water.

Embodiment 20 provides the method of any one of Embodiments 1-19, wherein about 5 wt % to about 20 wt % of the bentonite is at least one of feldspar, quartz, gypsum, dolomite, illite, mica, calcite, opal, dolomite, siderite, and clinoptilolite.

Embodiment 21 provides the method of any one of Embodiments 1-20, wherein about 7 wt % to about 13 wt % of the bentonite is at least one of feldspar, quartz, gypsum, dolomite, illite, mica, calcite, opal, dolomite, siderite, and clinoptilolite.

Embodiment 22 provides the method of any one of Embodiments 1-21, wherein the bentonite has a median particle diameter ($D_{50}$) of about 10 μm to about 600 μm.

Embodiment 23 provides the method of any one of Embodiments 1-22, wherein the bentonite has a median particle diameter ($D_{50}$) of about 40 μm to about 150 μm.

Embodiment 24 provides the method of any one of Embodiments 1-23, wherein the bentonite has a median particle diameter ($D_{50}$) of about 75 μm.

Embodiment 25 provides the method of any one of Embodiments 1-24, wherein the aluminum hydroxide is about 10 wt % to about 90 wt % of the composition.

Embodiment 26 provides the method of any one of Embodiments 1-25, wherein the aluminum hydroxide is about 30 wt % to about 70 wt % of the composition.

Embodiment 27 provides the method of any one of Embodiments 1-26, wherein (mass of the bentonite):(mass of the aluminum hydroxide) is about 0.1:1 to about 10:1.

Embodiment 28 provides the method of any one of Embodiments 1-27, wherein (mass of the bentonite):(mass of the aluminum hydroxide) is about 0.5:1 to about 2:1.

Embodiment 29 provides the method of any one of Embodiments 1-28, wherein (mass of the bentonite):(mass of the aluminum hydroxide) is about 0.9:1 to about 1.1:1.

Embodiment 30 provides the method of any one of Embodiments 1-29, wherein the aluminum hydroxide is at least one of $Al(OH)_3$ and $Al_2O_3 \cdot 3H_2O$.

Embodiment 31 provides the method of any one of Embodiments 1-30, wherein the aluminum hydroxide is at least one of gibbsite, bayerite, doyelite, and nordstrandite.

Embodiment 32 provides the method of any one of Embodiments 1-31, wherein the aluminum hydroxide has a median particle diameter ($D_{50}$) of about 10 μm to about 600 μm.

Embodiment 33 provides the method of any one of Embodiments 1-32, wherein the aluminum hydroxide has a median particle diameter ($D_{50}$) of about 40 μm to about 150 μm.

Embodiment 34 provides the method of any one of Embodiments 1-33, wherein the aluminum hydroxide has a median particle diameter ($D_{50}$) of about 75 μm.

Embodiment 35 provides the method of any one of Embodiments 1-34, wherein the aluminum hydroxide and the bentonite have a median particle diameter ($D_{50}$) that is within about 500 μm of one another.

Embodiment 36 provides the method of any one of Embodiments 1-35, wherein the aluminum hydroxide and the bentonite have a median particle diameter ($D_{50}$) that is within about 50 μm of one another.

Embodiment 37 provides the method of any one of Embodiments 1-36, wherein the aluminum hydroxide and the bentonite have a median particle diameter ($D_{50}$) that is about the same.

Embodiment 38 provides the method of any one of Embodiments 1-37, wherein the composition further comprises a flow agent or anticaking agent.

Embodiment 39 provides the method of Embodiment 38, wherein the flow agent or anticaking agent comprises at least one of silica, hydrophobically modified silica, sodium silicate, calcium silicate, tricalcium phosphate, magnesium stearate, sodium bicarbonate, potassium bicarbonate, magnesium trisilicate, talc, sodium aluminosilicate, potassium aluminosilicate, calcium aluminosilicate, aluminum silicate, and polydimethylsiloxane.

Embodiment 40 provides the method of any one of Embodiments 38-39, wherein the flow agent or anticaking agent is about 0.001 wt % to about 5 wt % of the composition.

Embodiment 41 provides the method of any one of Embodiments 38-40, wherein the flow agent or anticaking agent is about 0.5 wt % to about 1 wt % of the composition.

Embodiment 42 provides the method of any one of Embodiments 1-41, wherein the composition further comprises an alkali metal bicarbonate, potassium chloride, an ammonium phosphate, a calcium phosphate, an addition product of urea with an alkali metal bicarbonate, a metal salt of a fatty acid, a silicone, a surfactant, and mica.

Embodiment 43 provides the method of any one of Embodiments 1-42, wherein the composition further comprises water, a base, an oil, an organic solvent, a viscosifier, a crosslinker, a starch, cellulose or cellulose derivative, a sugar, a density control agent, a density modifier, an emulsifier, a dispersant, a polymeric stabilizer, polyacrylamide, a polymer or combination of polymers, an antioxidant, a plasticizer, a filler or inorganic particle, a pigment or dye, a rheology modifier, a surfactant, a corrosion inhibitor, a gas, a salt, a lubricant, a dessicant, a filler, a surface modifying agent, or a combination thereof.

Embodiment 44 provides a method of fighting a fire, the method comprising:

contacting at least one of a class A fire, a class B fire, and a source thereof with a composition comprising about 60 wt % to about 90 wt % bentonite and about 30 wt % to about 70 wt % aluminum hydroxide, wherein the contacting is sufficient to extinguish at least part of the fire or decrease the intensity of at least part of the fire;

wherein the bentonite has a median particle diameter ($D_{50}$) of about 40 μm to about 150 μm, the aluminum hydroxide has a median particle diameter ($D_{50}$) of about 40 μm to about 150 μm, the median particle diameter ($D_{50}$) of the aluminum hydroxide and the median particle diameter ($D_{50}$) of the bentonite are within about 50 μm of one another, and (mass of the bentonite):(mass of the aluminum hydroxide) is about 0.5:1 to about 2:1.

Embodiment 45 provides a system for performing the method of any one of Embodiments 1-44, the system comprising:

a fire-extinguishing apparatus comprising the composition therein.

Embodiment 46 provides an apparatus for fire-fighting comprising:

a portable fire extinguisher comprising therein one or more pressurized gases; and a composition comprising bentonite and aluminum hydroxide;

wherein the one or more pressurized gases are configured in the portable fire extinguisher sufficiently to expel the composition upon triggering by a user of the portable fire extinguisher.

Embodiment 47 provides a composition for fire-fighting, the composition comprising:

bentonite; and aluminum hydroxide.

Embodiment 48 provides a composition for fire-fighting comprising:

about 60 wt % to about 90 wt % bentonite having a median particle diameter ($D_{50}$) of about 40 μm to about 150 μm;

about 30 wt % to about 70 wt % aluminum hydroxide having a median particle diameter ($D_{50}$) of about 40 μm to about 150 μm, wherein the median particle diameter ($D_{50}$) of the aluminum hydroxide and the median particle diameter ($D_{50}$) of the bentonite are within about 50 μm of one another;

wherein the composition is a dry powder composition, and the (mass of the bentonite):(mass of the aluminum hydroxide) is about 0.5:1 to about 2:1.

Embodiment 49 provides a method of preparing a fire-fighting composition, the method comprising:

forming a composition comprising bentonite; and aluminum hydroxide.

Embodiment 50 provides the composition, apparatus, or method of any one or any combination of Embodiments 1-49 optionally configured such that all elements or options recited are available to use or select from.

What is claimed is:

1. A method of fighting a fire, the method comprising:

contacting at least one of a fire or a source thereof with a dry powder composition comprising bentonite and aluminum hydroxide, wherein the dry powder is a flowable powder not suspended in any fluid media, wherein the dry powder composition is contacted with the fire or the source thereof by dispersing the composition prior to the contacting;

after the contacting, allowing the fire to cause the dry powder composition to transform to a modified composition, wherein the dry powder is transformed into a modified composition when the aluminum hydroxide dehydrates to lose water and the bentonite at least partially absorbs the water, forming an aqueous gel; and extinguishing at least a part of the fire with the modified composition or decreasing the intensity of at least part of the fire with the modified composition.

2. The method of claim 1, wherein 10 wt % to 90 wt % of the composition is the bentonite.

3. The method of claim 1, wherein the bentonite comprises at least one of sodium bentonite and calcium bentonite.

4. The method of claim 1, wherein 40 wt % to 100 wt % of the bentonite is montmorillonite.

5. The method of claim 1, wherein 5 wt % to 20 wt % of the bentonite is at least one of feldspar, quartz, gypsum, dolomite, illite, mica, calcite, opal, dolomite, siderite, and clinoptilolite.

6. The method of claim 1, wherein the bentonite has a median particle diameter ($D_{50}$) of 10 μm to 600 μm.

7. The method of claim 1, wherein the aluminum hydroxide is 10 wt % to 90 wt % of the composition.

8. The method of claim 1, wherein (mass of the bentonite):(mass of the aluminum hydroxide) is 0.1:1 to 10:1.

9. The method of claim 1, wherein the aluminum hydroxide is at least one of $Al(OH)_3$ and $Al_2O_3.3H_2O$.

10. The method of claim 1, wherein the aluminum hydroxide has a median particle diameter ($D_{50}$) of 10 μm to 600 μm.

11. The method of claim 1, wherein the aluminum hydroxide and the bentonite each have a median particle diameter ($D_{50}$) that is within 500 μm of one another.

12. The method of claim 1, wherein the composition further comprises a flow agent or anticaking agent.

13. A system for performing the method of claim 1, the system comprising:

a fire-extinguishing apparatus comprising the composition therein.

14. The method of claim 1, wherein 30 wt % to 70 wt % of the composition is bentonite and 30 wt % to 70 wt % of the composition is aluminum hydroxide.

15. A method of fighting a fire, the method comprising:

contacting at least one of the fire, or a source thereof with a dry powder composition comprising 30 wt % to 70 wt % bentonite and 30 wt % to 70 wt % aluminum hydroxide, wherein the dry powder is a flowable powder not suspended in any fluid media, wherein the contacting extinguishes at least part of the fire or decreases the intensity of at least part of the fire, wherein the dry powder composition is contacted with the fire or the source thereof by dispersing the composition prior to the contacting;

allowing the fire to cause the dry powder composition to transform to a modified composition, wherein the dry powder is transformed into a modified composition when the aluminum hydroxide dehydrates to lose water and the bentonite at least partially absorbs the water, forming an aqueous gel; and extinguishing at least a part of the fire with the composition or decreasing the intensity of at least part of the fire with the composition;

wherein the bentonite has a median particle diameter (D50) of 40 μm to 150 μm, the aluminum hydroxide has a median particle diameter (D50) of 40 μm to 150 μm, the median particle diameter (D50) of the aluminum hydroxide and the median particle diameter (D50) of the bentonite are within 50 μm of one another, and (mass of the bentonite):(mass of the aluminum hydroxide) is 0.5:1 to 2:1.

* * * * *